US007017678B1

(12) United States Patent
Alqadhi

(10) Patent No.: US 7,017,678 B1
(45) Date of Patent: Mar. 28, 2006

(54) THREADED STUD INSERTION TOOL

(75) Inventor: Muhannad S. Alqadhi, Post Falls, ID (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/405,182

(22) Filed: Apr. 2, 2003

Related U.S. Application Data

(63) Continuation-in-part of application No. 10/237,322, filed on Sep. 9, 2002, now abandoned.

(51) Int. Cl.
*B25B 13/50* (2006.01)

(52) U.S. Cl. ..... 173/1; 81/53.2; 29/264

(58) Field of Classification Search ..... 227/147, 227/156, 10; 81/52, 53.2, 58, 57.31, 120; 29/244, 256, 264; 173/1
See application file for complete search history.

(56) References Cited

U.S. PATENT DOCUMENTS 1,813,424 A * 7/1931 Roche ..... 81/53.2
2,336,157 A * 12/1943 Bayes ..... 81/53.2
3,290,968 A * 12/1966 Parnock et al. ..... 81/53.2
3,368,430 A * 2/1968 Levering ..... 81/53.2
3,769,861 A * 11/1973 Kisle et al. ..... 81/53.2
3,832,916 A * 9/1974 Schoeps ..... 81/464
4,651,596 A * 3/1987 Rachanski ..... 81/53.2
4,890,779 A * 1/1990 Giannuzzi ..... 227/147
4,895,055 A * 1/1990 Bisping et al. ..... 81/53.2
4,977,799 A * 12/1990 Yasutomi et al. ..... 81/53.2
4,982,625 A * 1/1991 Bonner ..... 81/53.2
5,492,039 A * 2/1996 Haikal et al. ..... 81/53.2
6,581,697 B1 * 6/2003 Giardino ..... 173/1
6,585,143 B1 * 7/2003 Schultz ..... 227/147

* cited by examiner

*Primary Examiner*—Scott A. Smith

(57) ABSTRACT

The present invention is directed to a tool assembly for improving the insertion of threaded studs into confined spaces. The tool assembly includes a shaft having a bearing surface and defining an opening that is spaced apart from the bearing surface. The tool assembly also includes a sleeve having a threaded inside surface portion and a non-threaded inside surface portion, the non-threaded inside surface portion defining an opening, the sleeve mounted to the shaft with the sleeve opening aligned with the shaft opening. The tool assembly further includes a stop member positioned in the shaft opening and sleeve opening.

13 Claims, 4 Drawing Sheets

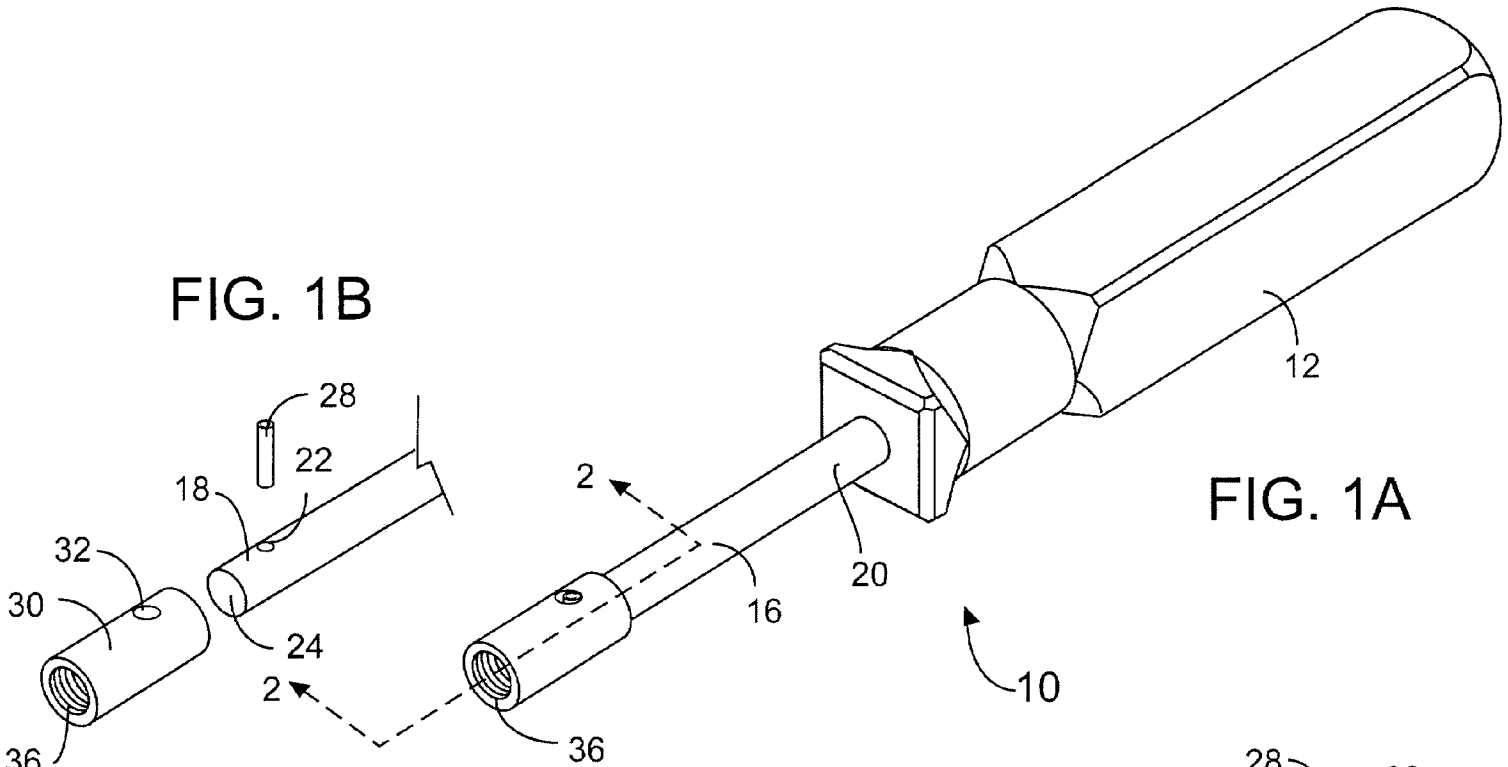
FIG. 1A
FIG. 1B
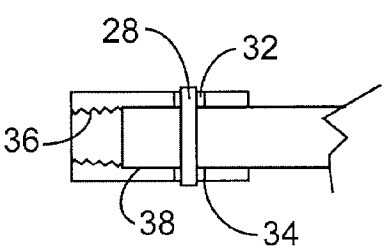
FIG. 2

FIG. 3
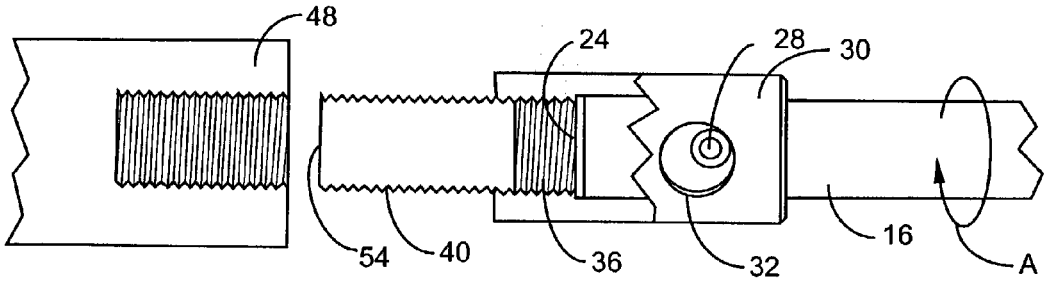
FIG. 4
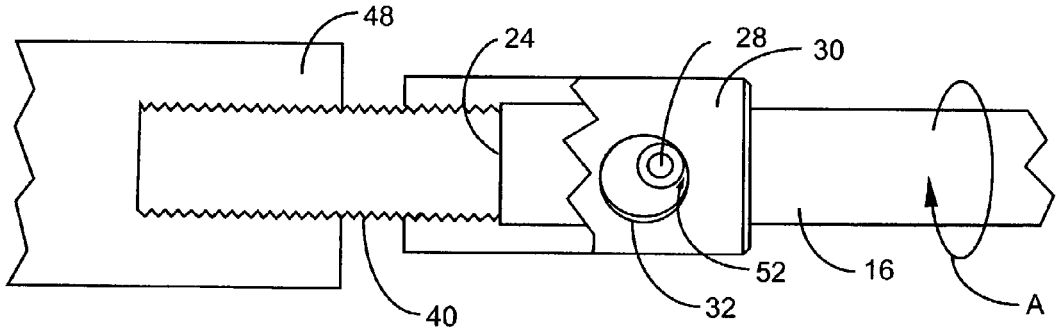
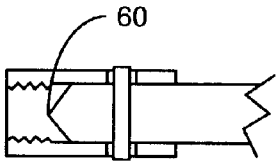
FIG. 6A
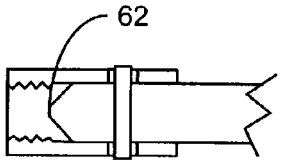
FIG. 6B
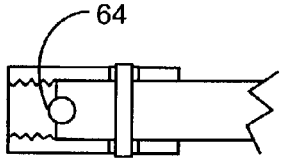
FIG. 6C

THREADED STUD INSERTION TOOL

RELATED APPLICATIONS

The present application is a continuation-in-part which claims priority to U.S. patent application Ser. No. 10/237,322 filed Sep. 9, 2002, titled "Threaded Stud Insertion Tool" to Muhannad S. Alqadhi now abandoned, the entirety of which is incorporated by reference.

FIELD OF THE INVENTION

In general, the invention relates to a tool for inserting threaded studs. More specifically, the invention relates to an apparatus for improving the insertion of threaded studs into confined spaces.

BACKGROUND OF THE INVENTION

In most cases, inserting threaded studs into a threaded hole is usually performed with little to no difficulty. In many applications, however, a threaded stud must be inserted into a hole that is out of reach or within a confined space. In situations such as these, conventional tools are not suitable.

Prior tools often are too large to use in confined spaces. Other tools are difficult to use and may cause damage to the threaded stud. One example of a prior art tool used to insert threaded studs jams two nuts against each other in order to provide the necessary torque to insert the stud. This device is not efficient, can damage the stud to be inserted and cannot be used in a confined space.

It is desirable, therefore, to provide a device that overcomes these and other disadvantages.

SUMMARY OF THE INVENTION

The invention is directed to a tool assembly and method for inserting threaded studs into threaded holes located in confined spaces. The invention allows a user to insert a threaded stud into a threaded hole located in a confined space and to extract the tool while leaving the inserted stud behind.

The tool assembly includes a shaft having a bearing surface. The shaft further includes an opening that is spaced apart from the bearing surface. The tool assembly also includes a sleeve having a threaded inside surface portion and a non-threaded inside surface portion, the non-threaded inside surface portion defining an opening, the sleeve is mounted to the shaft with the sleeve opening aligned with the shaft opening. The tool assembly further includes a stop member positioned in the shaft opening and sleeve opening.

A stud received in the threaded inside surface portion of the sleeve contacts the bearing surface of the shaft while the stop member prevents rotation of the sleeve when the shaft is rotated in a first direction to insert the stud in a threaded opening. The inserted stud is released from the sleeve when the shaft is rotated in a second direction.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

FIG. 1A is a perspective view illustrating a threaded stud insertion tool in accordance with the present invention;

FIG. 1B is a detailed perspective view of the threaded stud insertion tool illustrated in FIG. 1A in accordance with the present invention;

FIG. 2 is a cross-sectional view of the device illustrated in FIG. 1A in accordance with the present invention;

FIG. 3 is a partial cross-sectional view of the device of FIG. 1A having a threaded stud partially inserted in accordance with one embodiment of the present invention;

FIG. 4 is a partial cross-sectional view of the device of FIG. 1A having a threaded stud fully inserted in accordance with one embodiment of the present invention;

FIGS. 6A to 65C are cross sectional views of alternative embodiments to the structure depicted in FIG. 2;

DETAILED DESCRIPTION OF THE PRESENTLY PREFERRED EMBODIMENT

Figure 5:
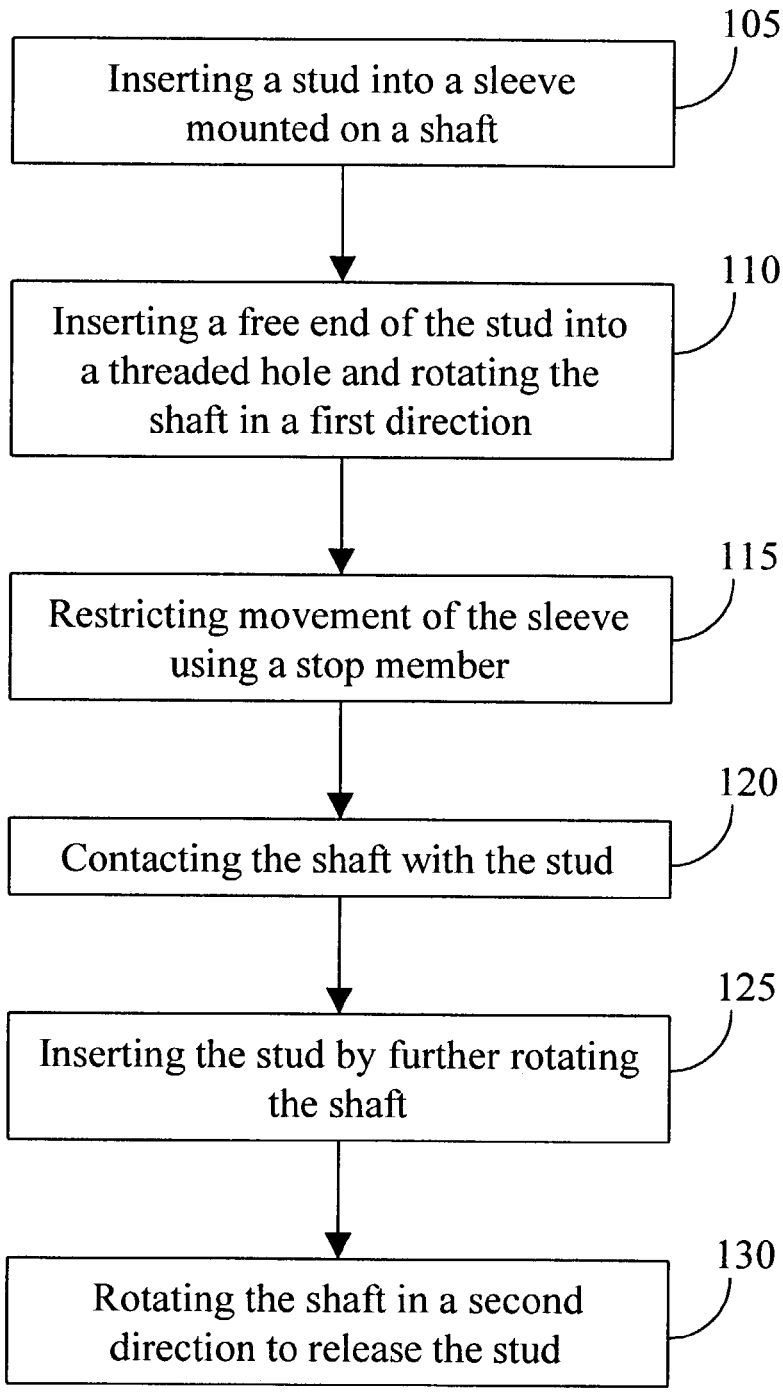
FIG. 5 is a flow chart illustrating a method of using the threaded stud insertion tool represented in FIG. 1B in accordance with the present invention

Referring now to the drawings, FIG. 1A, FIG. 1B and FIG. 2 illustrate one embodiment of the threaded stud insertion tool assembly 10 in accordance with the present invention. The tool assembly 10 may be used to insert a threaded stud into a threaded blind hole. Tool assembly 10 is adaptable for use in other applications where threaded studs are to be inserted into confined spaces.

Tool assembly 10 includes handle 12, shaft 16, sleeve 30 and stop member 28. In one embodiment, stop member 28 is a dowel pin. Tool assembly 10 can be driven by hand or driven by machine.

In one embodiment, handle 12 is fixedly attached to shaft 16. Handle 12 may be modified to any type of driver handle as needed. For example, the handle may be a screwdriver handle, a torque driver handle, a socket insertion adapter of any sort, or another rotating mechanism suitable for use as a handle. Alternatively, handle 12 may be adapted for use in a power tool or other type of mechanical rotating device. In another embodiment, the handle end of shaft 16 can be adapted to include any socket wrench type adapter, or any hexagonal shaft for all types of mechanized driver. In yet another embodiment, tool assembly 10 does not include a handle but has a shaft adapted for use with a power tool.

Shaft 16 of tool assembly 10 has a drive end (proximal end) 20 and a driven end (distal end) 18. Proximal end 20 is fixedly attached to handle 12. In one embodiment, proximal end 20 of shaft 16 is embedded in handle 12. In yet another embodiment, shaft 16 may extend throughout handle 12. In another embodiment, proximal end 20 of shaft 16 functions as handle 12 and is modified to provide a grip for the user. In yet another embodiment proximal end 20 of shaft 16 is adapted for use in a power tool or other type of mechanical rotating device.

Shaft 16 is composed of material that is wear resistant and not readily deformable due to repeated usage. In one embodiment, for example, shaft 16 is composed of tool steel hardened to RC 55-60. In another embodiment, shaft 16 is composed of hardened stainless steel.

Driven end 18 of shaft 16 includes bearing surface 24. When fully inserted into tool assembly 10, stud 40 (as shown in FIG. 3) abuts bearing surface 24. In one embodiment, bearing surface 24 is a low friction surface that minimizes the friction between the stud 40 and the end of shaft 16 and facilitates release of the stud from the tool assembly once the stud has been fully inserted into the threaded hole. In another embodiment, bearing surface 24 is composed of a material hard enough to withstand repeated contact of stud 40.

Distal end 18 of shaft 16 also defines opening 22 that extends laterally through shaft 16 and is spaced apart from bearing surface 24. During assembly of the tool, stop member 28 is press fit into opening 22. In one embodiment, dowel pin 28 is composed of the same material or a harder material as that of the shaft 16 into which the dowel pin is inserted.

Cylindrical sleeve 30 includes openings 32 and 34 (shown in FIG. 2), threaded inside surface portion 36 and non-threaded inside surface portion 38. In one embodiment, sleeve 30 is composed of the same material and hardness as that of the shaft 16 and dowel pin 28. Openings 32, 34 are positioned on opposing sides of sleeve 30 such that during assembly of the tool, openings 32, 34 are aligned with opening 22 of shaft 16 through which dowel pin 28 is press fit into place. Openings 32, 34 provide a bearing surface against which stop member 28 presses during rotation of the shaft. In one embodiment, openings 32, 34 are circular in shape and have a diameter at least twice that as the diameter of the dowel pin.

Sleeve 30 also includes a bore having a threaded inside surface portion 36 and a non-threaded inside surface portion 38. The threads of the threaded inside portion match the threads of the threaded stud 40. In one embodiment the inside threaded surface portion 36 includes 3–4 threads. Those skilled in the art will recognize that the threaded inside surface portion of sleeve 30 may vary in the number of threads, depending on the size and length of the threaded stud to be inserted. The distal end 18 of shaft 16 loosely fits within the non-threaded inside surface portion of sleeve 30 when the tool is assembled. Once assembled, sleeve 30 is free to move axially and rotationally on shaft 16 with the movement of sleeve 30 controlled by stop member 28.

In FIGS. 3 and 4, like elements are labeled identically to those of FIGS. 1A and 1B. FIGS. 3 and 4 illustrate the movement and placement of the stop member 28 during use of the tool assembly 10 to insert stud 40 into a threaded hole 48.

FIG. 5 illustrates a method of using the threaded stud insertion tool represented in FIG. 1B. Referring now to FIGS. 3 to 5, the method begins with the user of the tool loosely threading the stud 40 into the threaded inside surface portion 36 of sleeve 30 (Block 105). The user next inserts the free end 54 of the stud in the threaded hole 48 and rotates the handle in a first direction (Block 110). In one embodiment, this first direction is a clockwise direction as indicated by arrow A of FIG. 3. Rotating the shaft in the first direction causes the dowel pin to contact a bearing surface of opening 32 and 34 (not shown in FIG. 3, but shown in FIG. 2) of sleeve 30. Continued rotation of the tool assembly moves the dowel pin along an upward slope of opening 32, 34 and threads the stud into the sleeve 30 restricting the movement of the sleeve (Block 115). Further rotation puts the stud 40 into contact with the bearing surface 24 of shaft 16 (Block 120). Once the stud 40 is in contact with the bearing surface 24 of the shaft, continued rotation of the handle tightens the stud and the shaft into a locked position such that they act as a single unit.

At this point, the dowel pin 28 ceases to move along the upward slope of the bearing surface of openings 32, 34. A release gap 52 is formed on the downward slope between the dowel pin 28 and the bearing surface of, openings 32, 34. Further rotation of the handle screws the stud 40 into the threaded hole 48 (Block 125). The user will continue the rotation of the tool assembly 10 until the stud bottoms out in the threaded hole 48.

To disengage the tool assembly 10 from the fully inserted stud 40, the user rotates the tool assembly in a second direction that is opposite of that of the first direction (Block 130). In one embodiment, the second direction is a counter clockwise direction. Rotation of the tool assembly 10 in the second direction towards the release gap 52 moves the dowel pin 28 off of the upward slope and starts movement of the dowel pin down the slope of the bearing surface of opening 32, 34. This movement of the dowel pin 28 provides the motion necessary to release the stud from the bearing surface of shaft 16. The force required to rotate the tool assembly 10 in the second direction is less than the force exerted on the bearing surface by the stud that has been inserted in the threaded opening. Continued rotation of the tool assembly 10 in the second direction releases the tool assembly 10 fully from the inserted stud 40 thereby enabling the user to extract the tool without extracting the stud.

As depicted in FIG. 1B, bearing surface 24 is a flat surface on the driving end of shaft 16. Minimizing friction between the shaft and the stud is critical to the tool's ability to release the stud from the shaft when the rotation is reversed. Simple alternatives for the low friction bearing surface include a hard polished flat bearing surface, a hard and sharp end point, and a hard and semi round end point. Alternatively, other more complex bearing surfaces may be utilized, for example, a ball bearing surface or a disc bearing surface. FIGS. 6A to 6C illustrate alternative embodiments of low friction bearing surface 24 of shaft 16. The embodiments shown in FIGS. 6A to 6C reduce the amount of contact surface between the stud and the shaft each providing a low friction bearing surface that aids the release of the shaft from the stud when the tool assembly is turned in the second direction. FIG. 6A depicts a bearing surface 60 having a pointed end. Pointed bearing surface 60 provides a minimum amount of contact between the end of the shaft and the stud. FIG. 6B depicts a shaft having a rounded point bearing surface 62. Bearing surface 62 provides a surface having more contact with the stud, as compared to bearing surface 60, while still maintaining a low friction surface. FIG. 6C depicts yet another embodiment of the low friction bearing surface, the shaft having a ball bearing low friction bearing surface 64. In this embodiment, the ball bearing is free to move around inside the shaft end, providing a higher degree of motion freedom. This arrangement provides two surfaces for bearing the load, one between the shaft end and the ball, the other between the stud end and the ball. As a result of this load bearing disbursement, friction is spread out over a larger surface area, and, thus, less force is needed to break the stud end from the shaft end when the tool is rotated in the second direction.

Another embodiment of a low friction bearing surface (not shown) includes a Teflon coating on the bearing surface of the shaft. Yet another embodiment (not shown) includes a Teflon tip that is securely attached to the shaft end and provides a low friction bearing surface.

Figure 8A:
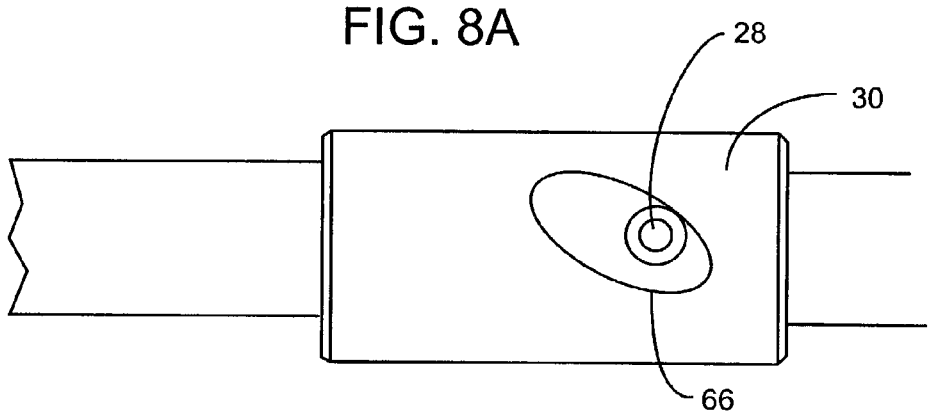
FIGS. 8A and 8B illustrate alternative embodiments of the sleeve member illustrated in FIG. 3 in accordance with the present invention.
Figure 8B:
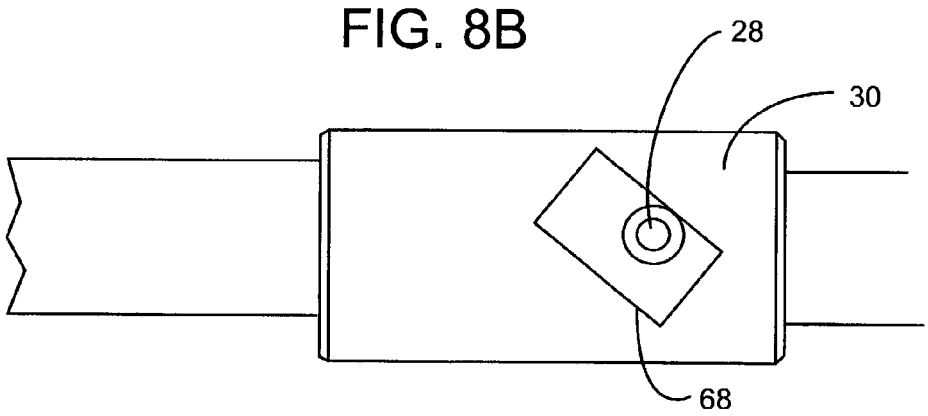

FIGS. 8A and 8B illustrate alternative embodiments of the sleeve member illustrated in FIG. 3. Each of the alternative embodiments provide an opening having an upward slope in the first direction of rotation and a downward slope in the second direction of rotation, where the first direction is the clockwise direction. FIG. 8A illustrates a sleeve 30 having an opening 66 with an oval shape. FIG. 8B illustrates another embodiment of a sleeve opening 68 having a rectangular shape. Those skilled in the art will recognize that there are many other embodiments that will provide the necessary upward slope in the first direction whether the first direction is clockwise or counter-clockwise.

Figure 7:
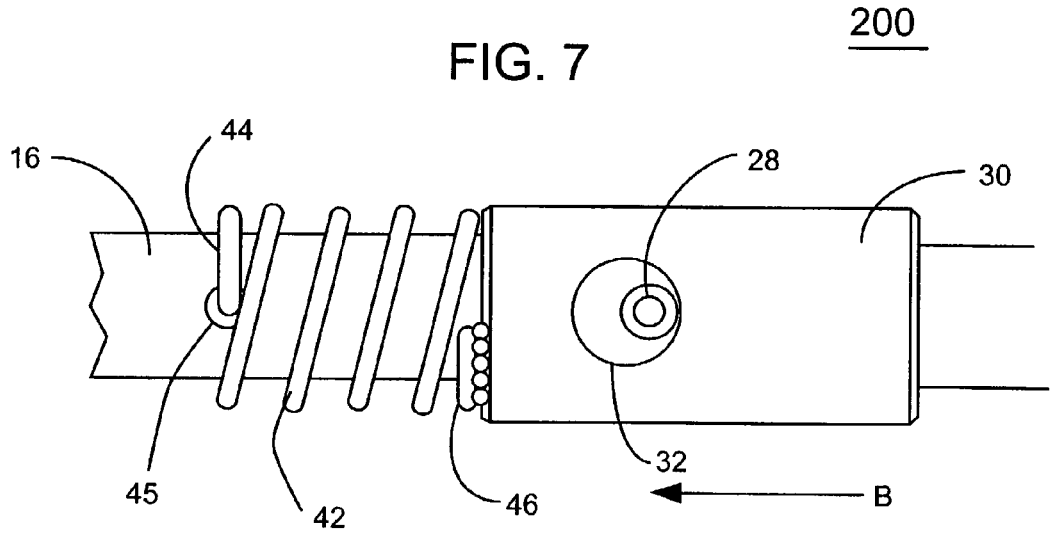
FIG. 7 illustrates another embodiment of the threaded stud insertion tool in accordance with the present invention.

FIG. 7 illustrates another embodiment of the threaded stud insertion tool where like elements are labeled identically to those of FIG. 1.

Tool assembly 200 illustrated in FIG. 7 includes the elements discussed above with reference to FIGS. 1A to 4. In addition, tool assembly 200 also includes spring 42. In one embodiment, spring 42 is a tension spring. In other embodiments, spring 42 may be any like device that provides tension to bias sleeve 30 towards shaft 16 as indicated by arrow B. Spring 42 includes a first end 44 and a second end 46. First end 44 is fixedly attached to shaft 16 and second end 46 is fixedly attached to sleeve 30. In one embodiment, first end 44 of spring 42 is fixedly attached to shaft 16 by inserting end 44 into a second opening 45 defined in shaft 16. Second end 46 is fixedly attached to sleeve 30 using a weld. In another embodiment (not shown) first end 44 is welded to shaft 16.

In operation tool assembly 200 is similar to that discussed above in relation to the tool assembly illustrated in FIGS. 1–4 once the stud is inserted into the sleeve. The tension supplied by spring 42 functions to place and maintain the stop member on an upward slope within opening 32 during the insertion of the stud into the sleeve. Additionally, this will ensure that the release gap is present when the threaded stud bottoms out in the hole, thus, making release of the tool assembly 200 from the inserted stud certain.

While the embodiments of the invention disclosed herein are presently considered to be preferred, various changes and modifications can be made without departing from the scope of the invention.

The scope of the invention is indicated in the appended claims. It is intended that all changes or modifications within the meaning and range of equivalents are embraced by the claims.

The invention claimed is:

1. A tool assembly for inserting a stud comprising:

a shaft including a bearing surface, the shaft defining an opening formed therein and spaced apart from the bearing surface;

a sleeve including a threaded inside surface portion and a non-threaded inside surface portion, the non-threaded inside surface portion defining an opening formed therein, the sleeve mounted to the shaft with the sleeve opening aligned with the shaft opening; and a cylindrical stop member fixedly positioned in the shaft opening and movably positioned in the sleeve opening;

wherein the stop member has a first diameter and the sleeve opening has a second diameter, the second diameter at least two times the size of the first diameter, wherein a stud received in the threaded inside surface portion of the sleeve contacts the bearing surface, the stop member slidably engages an upward slope of the sleeve opening responsive to rotation of the shaft in a first direction, the stop member prevents rotation of the sleeve when the shaft is rotated in the first direction to insert the stud in a threaded opening, and the inserted stud is released from the tool assembly when the shaft is rotated in a second direction.

2. The tool assembly of claim 1 wherein the bearing surface of the shaft is a low friction bearing surface.

3. The tool assembly of claim 2 wherein the low friction bearing surface is selected from a group consisting of: a flat polished bearing surface, a pointed bearing surface, a rounded pointed bearing surface, a round disc bearing surface, a ball bearing bearing surface, and a Teflon coated bearing surface.

4. The tool assembly of claim 1 wherein the bearing surface of the shaft is a Teflon tip securely connected to the shaft.

5. The tool assembly of claim 1 wherein the sleeve opening includes an upwardly sloping bearing surface in the first direction and a downwardly sloping bearing surface in the second direction.

6. The tool assembly of claim 1 wherein the sleeve opening is circular.

7. The tool assembly of claim 1 further comprising:

a spring having a first end fixedly attached to the shaft and a second end fixedly attached to the sleeve.

8. The tool assembly of claim 1 wherein a force needed to rotate the tool assembly in the second direction is less than the force exerted by a tightly fastened stud inserted in the threaded opening.

9. A method of inserting a stud into a threaded opening, the method comprising:

providing a sleeve mounted on a shaft, a stop member positioned through a sleeve opening aligned with a shaft opening, the stop member fixedly positioned within the shaft opening and the sleeve opening having a diameter at least twice that of the stop member;

inserting a stud into a threaded portion of the sleeve;

rotating the shaft in a first direction;

moving the stop member along an upward slope of the sleeve opening in response to the rotation to urge the bearing surface toward the stud:

restricting movement of the sleeve relative to the shaft with the stop member;

contacting a drive end portion of the stud against a bearing surface of the shaft; and further rotating the shaft and sleeve to insert the stud in the threaded opening.

10. The method of claim 9 further comprising:

rotating the shaft in a second direction opposite the first direction; and releasing the stud as a result of the second direction of rotation.

11. The method of claim 9 wherein restricting movement of the sleeve relative to the shaft with the stop member comprises ceasing the movement of the stop member in relation to the sleeve opening.

12. The method of claim 9 further comprising:

forming a stop gap between the stop member and the sleeve opening on a downward slope of the sleeve opening.

13. A stud insertion tool comprising:

means for receiving a first end of a stud;

means for contacting with the first end of the stud; and a cylindrical stop means for operably connecting the receiving means and the contacting means, wherein the means for receiving includes an opening for receiving the stop means, the opening having a diameter at least twice that of the cylindrical stop means.

* * * * *

UNITED STATES PATENT AND TRADEMARK OFFICE

CERTIFICATE OF CORRECTION

PATENT NO. : 7,017,678 B1
APPLICATION NO. : 10/405182
DATED : March 28, 2006
INVENTOR(S) : Alqadhi It is certified that error appears in the above-identified patent and that said Letters Patent is hereby corrected as shown below:

In column 6, line 38, in Claim 9, delete “stud:” and insert -- stud; -- therefor.

Signed and Sealed this

Eighteenth Day of July, 2006

JON W. DUDAS
*Director of the United States Patent and Trademark Office*